United States Patent [19]

Tamura

[11] 4,119,683

[45] Oct. 10, 1978

[54] CHOKE BREAKER SYSTEM FOR A CARBURETOR OF AN INTERNAL COMBUSTION ENGINE

[75] Inventor: Tetsuomi Tamura, Toyota, Japan

[73] Assignee: Toyota Jidosha Kogyo Kabushiki Kaisha, Toyota, Japan

[21] Appl. No.: 837,702

[22] Filed: Sep. 29, 1977

[30] Foreign Application Priority Data

May 31, 1977 [JP] Japan ..... 52-62781

[51] Int. Cl.[2] ..... F02M 1/10

[52] U.S. Cl. ..... 261/39 B; 123/119 F; 261/64 C

[58] Field of Search ..... 123/119 F; 261/39 A, 261/39 B, 64 B, 64 C

[56] References Cited

U.S. PATENT DOCUMENTS

| | | | |
|---|---|---|---|
| 3,190,623 | 6/1965 | Ball | 261/39 B |
| 3,831,567 | 8/1974 | Freismuth et al. | 261/39 B |
| 3,905,345 | 9/1975 | Nakada et al. | 123/119 F |
| 3,934,565 | 1/1976 | Matsumoto et al. | 123/119 F |
| 3,991,731 | 11/1976 | Benjamin | 261/39 B |

*Primary Examiner*—Tim R. Miles

[57] ABSTRACT

A choke breaker system for a carburetor of an internal combustion engine, wherein a negative pressure-type choke control means of a carburetor of an internal combustion engine is directly coupled with a vacuum port of the carburetor, a vacuum switching valve being controllable in response to an engine temperature and a negative pressure check valve are arranged in the passage of negative pressure, and only the vacuum switching valve is to be connected in series when the temperature of the engine is below a certain level, while the vacuum switching valve and the check valve are to be both connected in series when the temperature of the engine is in excess of the certain level.

8 Claims, 6 Drawing Figures

CHOKE BREAKER SYSTEM FOR A CARBURETOR OF AN INTERNAL COMBUSTION ENGINE

FIELD OF THE INVENTION

The present invention relates to a choke breaker system for a carburetor of an internal combustion engine. In an internal combustion engine coupled with a carburetor to be employed in a vehicle, when the engine is in a comparatively cooled state, the vaporization property of a fuel is rather deficient and resistance of revolution of the engine is rather high and therefore, it is imperative that the mixture ratio of the fuel be raised and the number of revolutions of the engine be increased to thus promote warming-up of the engine; now, what have been thus far made available in this field includes such wherein atmospheric temperature or exhaust gas temperature selects the cooling water temperature as a control element thus effecting actuation of a check valve, and one of an electric type; besides, a fast idling mechanism specifically designed to open a throttle valve to increase the number of revolutions at the time when temperature is low, also an unloader mechanism specifically designed to move a choke valve to forced opening when a mixture (mixed gas) becomes rich and a similar mechanism are included in the category of automatic choke devices.

Now, when an engine in a cooled state is started and a vehicle begins to move, the automatic choke valve is kept closed, whereby a concentrated mixture is induced and large quantities of HC and CO are generated. Therefore, for the purpose of moving the choke valve to forced opening to induce sufficient air and preventing the mixture from becoming rich, a velocity sensor, a thermoswitch (for cooling water outlet temperature), a thermosensor (an intake manifold) are specifically selected as control elements, a vacuum switching valve (VSV) is subjected to proper conrol through a computer and a diaphragm is controlled adequately by virtue of negative pressure applied through the intake manifold, whereby opening and closing of the choke valve are controlled adequately.

In case the engine is kept in a warmed-up state to a certain degree in the process of warming up the engine, however, continuous tread on the accelerator causes a choke breaker to be kept actuated by virtue of the negative pressure in a suction tube and acceleration at full admission results in decrease in negative pressure, whereby the choke valve is closed thus resulting in excessive concentration in terms of the mixture and bringing about an undesirable state, for example a stall, and in overheating of an exhaust system in the case of a vehicle provided with a catalyst processing apparatus. No trouble of this category, of course, takes shape in cold climate.

To cope with such a situation, in the case of the technology available at present, either a check valve or a vacuum transmission valve (VTV) is arranged in series on a circuit formed between a vacuum port and a choke breaker, thus preventing the choke valve from closing. In case of this system, however, either the choke valve remains open at the time of restart, or it takes time before the choke valve is closed and especially, when the engine is not thoroughly warmed up, a mixture of desirable degree of concentration cannot be obtained, thus resulting in defective starting.

SUMMARY OF THE INVENTION

One object of the present invention is to provide a system wherein a vacuum check valve and a vacuum switching valve having a designated level of engine temperature specifically selected as a couple of actuating elements are arranged in a negative pressure-type choke control circuit for the purpose of eliminating the above-mentioned defects in such a manner that, in case the engine is below a certain temperature level, a choke breaker and an intake manifold are directly connected to each other and negative pressure in a suction tube is caused to be directly connected in a through manner with a choke breaker diaphragm to prevent the engine from resulting in defective restarting, while in case the engine is in excess of a certain temperature level, a check valve is set in place in series on the circuit in such a manner that the choke valve is kept free from being closed even in case a pressure is continuously applied to the accelerator pedal thus preventing a mixture from becoming rich.

Another object of the present invention, and the effect thereof, is to provide, at low cost, such a quite simplified means as is specifically contrived for the purpose of eliminating defective restarting, with regard to an automatic choke system of the conventional type, in case an engine still remains at a certain temperature level, if the engine stops, in a carburetor of a negative pressure-type choke breaker, a matter that has been thus far experienced quite frequently, and a variety of irregularities including overheating of a catalyst or a stall attributable to excessive concentration of a mixture resulting from continuous pressure applied to the accelerator pedal in the process of warming-up the engine, and/or generation of HC and CO attendant upon excessive concentration of a mixture at the time of vehicle movement immediately after starting same in a cooled state.

BRIEF DESCRIPTION OF THE DRAWINGS

FIG. 2 is a circuit diagram in the case wherein a choke opener and a choke breaker are different from each other in terms of working temperature, FIG. 3 and FIG. 4 are circuit diagrams in the case wherein working temperature is synchronized;

DETAILED DESCRIPTION OF THE INVENTION

A detailed description of the present invention will be given below with reference to the attached drawings.

Figure 1:
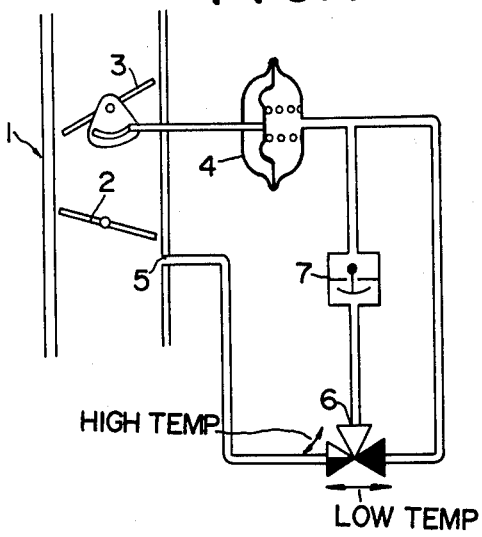
FIG. 1 is a diagrammatic representation of an outline of the arrangement of a choke breaker system for a carburetor of an internal combustion engine according to the present invention.
Figure 2:
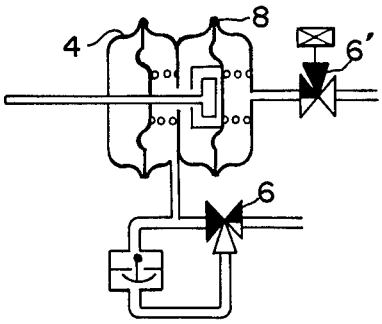
FIG. 2 through FIG. 4 are displays of respective embodiments illustrations of the choke breaker system according to the present invention, respectively representing the cases wherein an interlocking two-stage type choke breaker is employed, whereof
Figure 3:
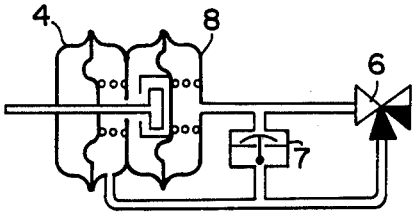
Figure 4:
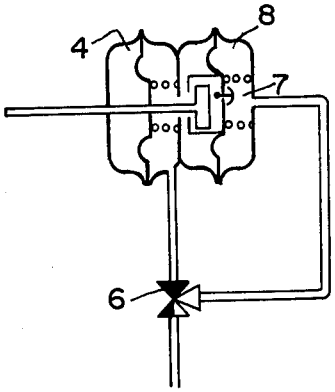
Figure 5:
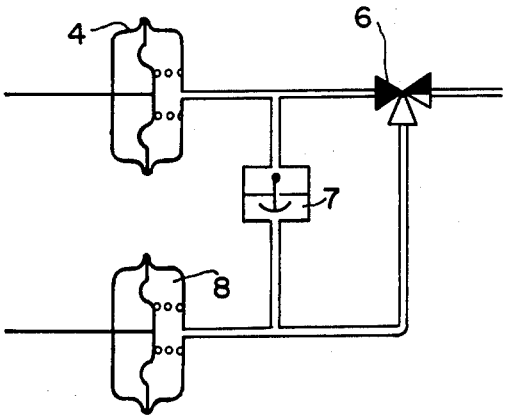
FIGS. 5 and 6 are two examples of circuit diagrams of embodiments wherein a choke opener and a choke breaker are arranged in series.

FIG. 1 is a diagrammatic representation of an outline of the arrangement of the choke breaker system for a carburetor of an internal combustion engine according to the present invention; FIG. 2 through FIG. 4 are displays of respective illustrations of the choke breaker system according to the present invention representing the cases wherein an interlocking two-stage type choke breaker is employed, whereof FIG. 2 is a circuit diagram wherein the choke opener and the choke breaker arranged for interlocking motion are different from each other in terms of working temperature, FIG. 3 and FIG. 4 are circuit diagrams wherein working temperature is synchronized; and FIG. 5 is a representation of an embodiment wherein the choke opener and the choke breaker are arranged in series.

In FIG. 1, a suction system 1 of the carburetor has a throttle valve 2, a choke valve 3 and a choke breaker 4 arranged thereon and negative pressure fed through a vacuum port 5 of a suction tube is then directly fed to a diaphragm chamber of the choke breaker 4 by way of a vacuum switching valve (VSV); besides, a check valve 7 is arranged in series between the vacuum switching valve (VSV) 6 and the diaphragm chamber.

The actuation of the vacuum switching valve (VSV) 6 is such that this valve 6 has a switching function at a present temperature level, with the temperature of the engine (for instance, the engine cooling water temperature, the intake air temperature, or the temperature of the main body of the engine) specifically selected as a control element.

The actuation of this system is as set forth below. The VSV 6 selects the system shown by the symbol ► in the drawing, the negative pressure in the suction tube is fed in a through manner to the diaphragm chamber of the choke breaker 4 only by way of the valve, and the check valve 7 is excluded form the working system. This represents the present state of the conventional system. Therefore, starting and restarting of the engine in the cooled state are facilitated as the induced mixture is at rich, whereof the description is as given in the foregoing paragraph. However, when the engine becomes higher in temperature than a designated level, the VSV 6 is connected with the system shown by the symbol ▷ in the drawing, and the negative pressure in the suction tube is fed to and connected with the choke breaker 4 by way of the VSV 6 and the check valve 7. When the negative pressure in the suction tube is comparatively high (that is to say, when the negative pressure is nearer to vacuum) in this state, the negative pressure is caused to work on the diaphragm of the choke breaker 4 by way of the check valve 7 by virtue of the negative pressure in the suction tube and the choke valve tends to be opened, thus preventing the mixture from being concentrated. Even in case pressure is applied to the throttle valve, whereby the negative pressure in the suction tube is reduced in level, the check valve 7 is closed and the diaphragm maintains the standing state of opening, without assuming the closed state immediately; therefore, generation of HC and CO attributable to excessive concentration of the mixture, which is prone to result in the case of operation wherein the accelerator pedal is kept in a continuously pressured state, and overheating of the exhaust system as well can be prevented in a proper manner. When the engine is cooled once again and reaches a certain level of temperature in this state, the choke valve tends to be closed by virtue of the actuation of the existing choke breaker and assumes a state suitable enough for coping with the condition at the time when cooling is under way. The actuation of the VSV and the actuation of the choke breaker may have the set temperature level thereof properly selected in a manner of being a desirable value.

FIG. 2 through FIG. 4 show some combination arrangements of the present invention in the case wherein the choke breaker means comprising an interlocking combination of the choke opener coupled with the choke breaker and the negative pressure type choke control means in each case is of the interlocking structure of the choke breaker 4 coupled with the choke opener 8. The choke breaker 4 and the choke opener 8 shown in FIG. 2 are such that the negative pressure system of the former is the same as that employed in the embodiment shown in FIG. 1, the negative pressure chamber and one chamber of the choke opener 8 are connected to each other in a through manner, the negative pressure chamber of the choke opener is properly formed through the diaphragm of the choke opener and the negative pressure chamber is connected with the vacuum port of the suction tube by way of a special VSV 6′ separately from the choke breaker system. In this embodiment, the VSV 6′ for the choke opener and the VSV 6 for the choke breaker are different from each other in terms of set temperature level and the VSV 6′ is so situated as to feed the negative pressure chamber with either the negative pressure (▷ system) or the atmosphere (► system), with the set level of temperature specifically selected as the border thereof. Therefore, the choke breaker system functions in the same manner as in the case of the embodiment shown in FIG. 1. However, in case the choke breaker system has the actuation of the choke opener to be effected at a temperature level different from that for the counterpart specifically added thereto, the actuation of the choke valve can be thereby simplified, thus being caused to conform to the state of operation of the engine.

Shown in FIG. 3 and FIG. 4 is the two-stage type choke breaker system contrived in the same manner as in the case of the embodiment shown in FIG. 2. However, in each case, the VSV 6 for the choke breaker and the VSV 6′ for the choke opener are so synchronized as to be of the same temperature level and the difference between the two lies in the fact that both are different from each other in terms of arrangement of the choke valve 7, while both are the same in terms of function to be displayed and the effect to be attained.

Figure 6:
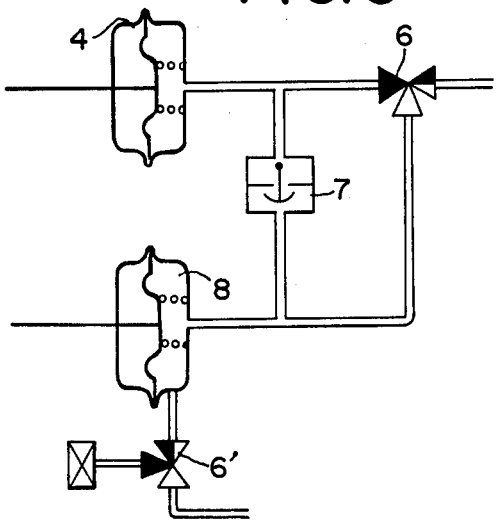

Shown in FIG. 5 and FIG. 6 are embodiments wherein the choke breaker 4 and the choke opener 8 are arranged in parallel to the VSV 6, whereof the former is provided with the same VSV 6, while the latter is provided with such separate VSV 6 and VSV 6′ as are different from each other in terms of working temperature thereof and the principle of the actuation thereof is clear and evident through the description of the embodiments given above, hence omitted herein.

What is claimed is:

1. A choke breaker system for a carburetor of an internal combustion engine comprising a negative pressure type choke control device directly connected with a vacuum port of a suction tube of the carburetor, a check valve and a vacuum switching valve being controllable in response to an engine temperature are arranged in the passage of the negative pressure formed between said vacuum port of the suction tube and said choke control device, and arrangement of said vacuum switching valve and said check valve is constituted in such a manner that only said vacuum switching valve is to be connected in series when the temperature of the engine is below a certain level, while said vacuum switching valve and said check valve are to be connected in series when the temperature of the engine is in excess of a certain level.

2. The choke breaker system set forth in claim 1, wherein said negative pressure-type choke control is a choke breaker diaphragm means.

3. The choke breaker system set forth in claim 1, wherein said negative pressure-type choke control device is of the interlocking combination structure of a choke breaker diaphragm means coupled with a choke opener diaphragm means.

4. The choke breaker system set forth in claim 1, wherein said negative pressure type choke control device is a structure of the parallel combination of a choke breaker diaphragm means coupled with a choke opener diaphragm means.

5. The choke breaker system set forth in claim 3, wherein respective means constituting said combination negative pressure control device are so constituted as to be put in synchronized actuation in a predetermined working temperature level of the engine.

6. The choke breaker system set forth in claim 3, wherein respective means constituting the said combination negative pressure control device are so constituted as to be put in actuation at predetermined temperature levels respectively different from each other.

7. The choke breaker system set forth in claim 4, wherein respective means constituting said combination negative pressure control device are so constituted as to be put in synchronized actuation at a predetermined working temperature level of the engine.

8. The choke breaker system set forth in claim 4, wherein respective means constituting said combination negative pressure control device are so constituted as to be put in actuation at the predetermined working temperature levels of the engine respectively different from each other.

* * * * *